United States Patent [19]

Rayle

[11] 4,092,927

[45] June 6, 1978

[54] DELAY ARMING MECHANISM FOR FUZES

[75] Inventor: Roy E. Rayle, Richmond, Ind.

[73] Assignee: Avco Corporation, Wilmington, Mass.

[21] Appl. No.: 775,809

[22] Filed: Nov. 14, 1968

[51] Int. Cl.[2] ..... F42C 15/26; F42C 15/28

[52] U.S. Cl. ..... 102/229; 102/244

[58] Field of Search ..... 102/7, 16, 71, 78–81

[56] References Cited

U.S. PATENT DOCUMENTS

| | | | |
|---|---|---|---|
| 1,850,196 | 3/1932 | Bardsley | 102/81 |
| 2,705,921 | 4/1955 | Moseman, Jr. | 102/78 |
| 3,007,412 | 11/1961 | Kipfer | 102/71 |
| 3,264,995 | 8/1966 | Libbey et al. | 102/79 |

*Primary Examiner*—Verlin R. Pendegrass
*Attorney, Agent, or Firm*—Abraham Ogman

[57] ABSTRACT

A fuze is disclosed for use on projectiles fired generally at high speed. A unique delay arming mechanism is incorporated which utilizes pressure build-up within the fuze to control the period of delay in arming the fuze. The delay mechanism is unique in that fuzes incorporating the invention can be used interchangeably on either fin or spin stabilized projectiles.

4 Claims, No Drawings

DELAY ARMING MECHANISM FOR FUZES

BACKGROUND OF THE INVENTION

This invention relates generally to ordnance fuzes and more particularly to fuzes incorporating a pressure responsive delay arming mechanism.

Prior art fuzes which include delay arming mechanism are subject to the limitation that their utility is limited to specific projectile types. In other words, fuzes which depend on forces created by a spinning projectile for arming, such as described in U.S. Pat. Nos. issued to Libby et al, 3,264,995, Aug. 9, 1966, and Myers et al, 3,366,059, Jan. 30, 1968, cannot be used with fin stabilized projectiles which have no spin.

In fin stabilized projectiles, the delay arming mechanism is generally more complicated and will include a plurality of interconnected spring and lever members.

It is an object of the present invention to provide a fuze with delay arming mechanism which overcomes the objections of prior art fuzes and can be used interchangeably with fin or spin stabilized projectiles.

Another object is to provide a delay arming mechanism which will prevent accidental arming during storage and handling, is economical to manufacture and has broad application in the field of ordnance.

A further object is to provide a delay arming mechanism for a fuze which will arm only when a predetermined dynamic pressure exists within the fuze.

Other objects and advantages of the present invention will be apparent to those skilled in the ordnance art.

SUMMARY OF THE INVENTION

The present invention describes a fuze with delay arming capabilities which can be used with either fin or spin stabilized projectiles. The use of ram air (for projectiles traveling through air) passing through an orifice in the fuze ogive provides the basis for the unique delay arming of the fuze. Pressure releasable locking means secures a detonator carrying slider element in the unarmed state. When the fuze inside pressure due to the ram air exceeds the locking force, the slider element is unlocked and is moved to the armed state and locked in this state to maintain the alignment of the detonator and an initiator. Means are provided to prevent fuze internal pressure build-up during storage and handling.

DESCRIPTION OF THE DRAWINGS

An illustrative embodiment of the present invention is shown in the following drawings, in which.

DESCRIPTION OF THE PREFERRED EMBODIMENT

Figure 1:
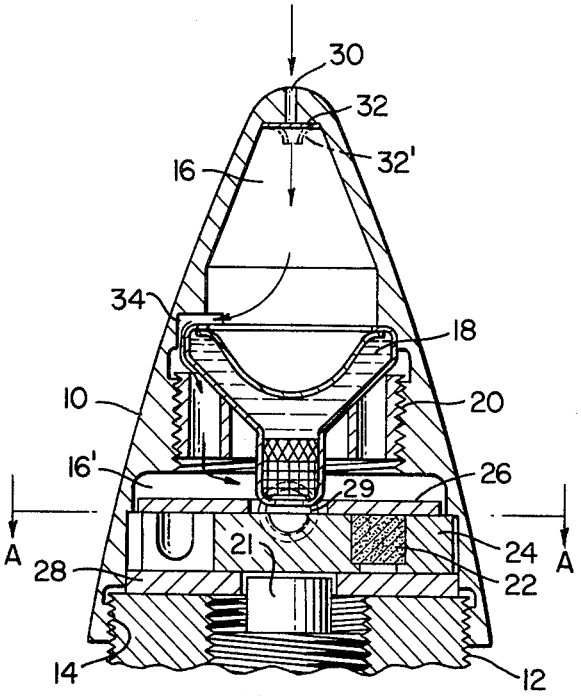
FIG. 1 is an elevational sectional view through a fuze structure in accordance with the invention.
Figure 2:
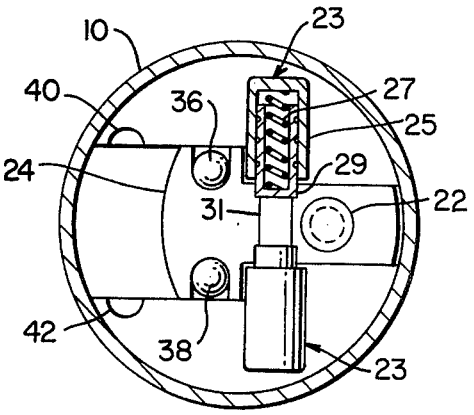
FIG. 2 is a cross-sectional view through the fuze along line A—A of FIG. 1 with a portion thereof broken away.

An illustrative embodiment of the present invention is shown in FIGS. 1 and 2 in which numeral 10 designates a conventional ogive which is screwed onto the lower fuze body 12 by screw threads 14. The ogive 10 defines front and rear chamber areas 16 and 16′, respectively, between which is disposed an initiator 18 carried by a support member 20. The support member may be secured to the ogive 10 by any suitable means such as by threadable engagement as shown herein. The initiator used to fire this fuze can be any of several types, and the pinch type initiator illustrated in this embodiment is shown only to clarify the application of the invention and is not meant to limit the scope of the invention. The operation of initiator 18 is fully disclosed in U.S. Pat. No., Myers et al, 3,366,059, and need not be explained here; it being sufficient to say that the initiator is actuated when certain conditions are met, i.e., contact of the ogive with another object. It will be apparent that initiators having different actuating conditions, such as proximity to metal, heat, signal activation, etc., can be used in this invention.

The detonator 22 is carried by a movable carrier mechanism which includes a slider element 24 held between a cover 26 and base 28 for sliding movement therebetween. The slider element 24 is locked in the unarmed state by pressure releasable locking means shown generally as 23—23. Each of the locking means 23 comprises a cylinder 25, a spring 27, and a piston 29. The arming of a slider fuze is disclosed in U.S. Pat. No., Libby et al, 3,264,995, and only those detailed considerations which are pertinent to the present invention shall be treated hereunder.

An orifice 30 is placed at the apex of the ogive 10 where dynamic air pressure will be maximum. This orifice is protected during storage and handling by a seal 32. The seal 32 can be a thin fusible member which melts due to aerodynamic heating or a deformable member which removes an elastic seal member when subjected to high linear acceleration indicative of gun fired projectiles. The numeral 32′ shows the seal 32 in a deformed or ruptured state which opens the orifice 30. With the orifice 30 opened and the projectile in flight, air enters the chamber 16 through the orifice 30 to build up air pressure inside the fuze. A plurality of passages shown generally as 34 provide communication between the chamber areas 16 and 16′ so that the pressure in both chamber areas will be the same. Chamber 16′ is in direct communication with the ends of pistons 29. Groove 31 provides further communication between chamber 16′ and the pistons 29. When the pressure exceeds the force of spring 27, piston 29 will be telescoped into cylinder 25 to unlock the slider element 24. A transverse force is imparted to the slider which is moved into the armed state as explained in the above-mentioned Libby patent so that detonator 22 is aligned with initiator 18. Hence, actuation of initiator 18 in turn actuates the detonator 22, which provides the desired "high order" detonation through the lead cup 21 to the main explosive charge. The slider element 24 is locked in the armed state by balls 36 and 38 which are forced outward into detents 40 and 42 in a known manner and need not be explained here. Thus, it is the controlled build-up of pressure acting on pistons 29 (plus centrifugal force acting on the piston in spin type applications), required to overcome the spring force, which permits the delay arming.

When this delay mechanism is used with a spin type projectile, the biasing spring 27 inside the double-acting cylinder 25 is designed initially to overcome the centrifugal force acting on the piston 29 plus the pressure force resulting from the controlled bleeding of the ram air through the orifice 30. Those skilled in the art will realize that the pressure inside the fuze to cause arming must be built up to a level between ambient and the dynamic pressure at the orifice. In addition, the pressure build-up within the cylinder 25 must be held to a minimum if arming is to be releasable. The build-up in pressure inside the cylinder 25 is held to a minimum by making the clearance between the piston 29 and cylinder 25 small, such as by using labyrinth seals, using dynamic seal members, or lubricant and by holding the change in volume to a minimum, i.e., by using a short stroke.

The cylinder and spring system are proportioned to give positive arming at a given pressure level. This desired arming action is achieved by making the change in total force, due to the change in pressure inside the cylinder plus the change in spring force due to spring rate, equal to the centrifugal force due to the spin after partial displacement of the center of gravity of the piston has occurred. To illustrate this basic action, assume that each spring 27 has a very low rate, no leakage takes place, and the volume of each cylinder 25 is large. It is clear now that each piston 29 will move at an accelerated rate when the desired pressure to arm is reached since the centrifugal force will increase linearly, and the opposing spring force will also increase linearly with the outward displacement of the center of gravity of the piston 29. The cylinder and piston system can be replaced with weights and roll bellows to preclude any seal problems and a cylinder arrangement is shown here as a preferred configuration. It is seen that, when used with spin type projectiles, the fuze will be designed so that arming requires both spin and ram air, i.e., two environments. When the fuze is used with high velocity projectiles, aerodynamic heating can be used as a third arming environment by use of a fusible plug 32 over the orifice.

Figure 3:
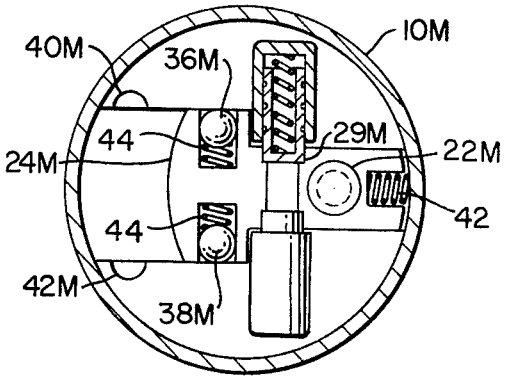
FIG. 3 is cross-sectional view through the fuze along line A—A of FIG. 1 with a portion thereof broken away and showing a modification of the invention.

In addition to spin type projectiles, this fuze can be used with fin stabilized projectiles as seen in the modified form in FIG. 3 wherein components which are the same in both embodiments are designated with a suffix "M." When used with fin stabilized projectiles (no spin), the slider is formed with pockets aft of its leading face in which are disposed locking balls 36M and 38M, each biased outwardly by its respective spring 44, positioned between slider and ball. The trailing face of the detonator carrying slider is formed with a pocket into which the compression spring 42 is disposed. This is the arming spring which always tends to urge the slider into the armed position and does displace it into the armed position when the slider is unlocked. In design, the force due to spin acting on the pistons 29M need not be considered since pressure in the fuze will be the only major force to consider. Since there are no forces acting on balls 36M and 38M, springs 44 urge the balls into the detents 40M and 42M to lock slider 24M in the armed state. It is seen that the modification shown in FIG. 3 can be used in either fin or spin stabilized projectiles since the spring 42 provides the force to move the slider element to the armed state. When a fuze employing this invention is used with fin stabilized projectiles, the fuze will act as a distance integrator since the total flow through the orifice will tend to be a function of the product of velocity and time. A second safety may be provided by a set-back pin sensing the set-back force on the fin stabilized projectile at launch, which may be used to partially unlock the slider 24.

When this fuze is used with a rocket, the design can be modified to give fail-safe operation by making the pressure to arm greater than the dynamic pressure at launch but less than the dynamic pressure indicative of the velocity at the correct arming distance. Under these conditions, the fuze would not arm (no increase in dynamic pressure) if the motor failed at launch.

Although the ogive shown herein is in one piece, the orifice and seal arrangement can be a threaded subassembly which can be replaced to vary arming distance when the fuze is used with a given gun, or rocket system. Further, the ram air system tends to be self-compensating as to temperature, in that low temperature effects include an increase in air density, and this tends to shorten arming time, compensating for the normal experience of longer arming time at low temperatures due to such factors as increased viscosity of lubricants. In addition, the orifice arrangement can be designed to give various arming distances by using a valve type orifice which could be set at the time of firing to give the required flow rate required for a given arming distance.

The invention disclosed herein has broad application in the field of ordnance since the invention is simple, economical, redundant in nature and highly adaptable. The fuze embodying this invention can be implemented to include the field of underwater ordnance where the force of water impact will open the orifice 30 and the pressure head at a given depth would arm the device. This invention can be used on air-dropped ordnance by making the orifice 30 open at time of drop to allow ram air during the fall to complete the arming of the device. These applications are but a few of the broad range warranted by the basic nature of this invention and do not limit the scope of the invention.

While the forms of delay arming mechanism herein described constitute preferred embodiments of the invention, it is to be understood that the invention is not limited to this precise form of apparatus.

What is claimed is:

1. A fuze having controlled arming means to provide a preselected delay interval for use on either fin or spin stabilized projectiles comprising:

an ogive of generally conical configuration formed with an apex, said ogive defining a chamber therein;

an orifice formed at the apex of said ogive providing communication between the external fluid environment through which the projectile travels and the ogive chamber;

an initiator;

a support member mounting said initiator in said ogive chamber wherein said initiator divides said chamber into a first and second chamber, said first chamber being in communication with said orifice;

said support member defining a plurality of passageways providing communication between said first and second chamber;

a transversely extending carrier mounted for transverse displacement relative to said ogive in response to a transverse force, said carrier being mounted in the end opposite the apex;

a detonator mounted in said carrier for movement therewith;

pressure releasable locking means for normally locking said carrier in an unarmed state but responsive to pressure increases within the first and second chambers to release said locking means thereby permitting transverse movement of said carrier to an armed state, said pressure releasable locking means including a locking member acting on each side of said carrier, each of said members comprising a cylinder, a piston mounted in said cylinder for telescopic movement therewith wherein the end of said piston is in communication with said second chamber, and a spring coacting between said cylinder and piston urging said piston into locking engagement with said carrier wherein pressure increases in said first and second chamber due to fluid entering said chambers through said orifice will act on said piston whereby the controlled build-up of pressure acting on said piston to overcome the spring force provides a preselected delay interval causing the controlled arming delay from the unarmed to the armed state;

second locking means mounted in said carrier for locking said carrier in the armed state and releasable seal means cooperatively associated with said orifice to separate said first chamber from the external environment prior to the firing of said projectile, thereby providing an additional operational delay for arming.

2. A fuze as set forth in claim 1 in which said carrier is formed to be unbalanced wherein the transverse force is imparted to said carrier by centrifugal force due to projectile spin and thereby moving said carrier to the armed state in response to the centrifugal force.

3. A fuze as set forth in claim 2 further comprising a spring mounted to act against said carrier wherein the transverse force due to centrifugal force is augmented by the spring force.

4. A fuze as set forth in claim 1 further comprising a spring mounted in the end opposite the ogive apex for coacting with said carrier to provide the transverse force to move said carrier from the unarmed to the armed state.

* * * * *